United States Patent [19]

Davis

[11] 4,100,624

[45] Jul. 18, 1978

[54] METHOD AND APPARATUS FOR FORMING A COMBINATION GARMENT AND PRODUCTS THEREOF

[75] Inventor: Farris L. Davis, West Fork, Ark.

[73] Assignee: Bear Brand Hosiery Co., Chicago, Ill.

[21] Appl. No.: 704,700

[22] Filed: Jul. 12, 1976

[51] Int. Cl.[2] ..... A41B 9/04

[52] U.S. Cl. ..... 2/409

[58] Field of Search ..... 2/409, 408, 406, 407, 2/227, 243; 66/177

[56] References Cited

U.S. PATENT DOCUMENTS

| | | | |
|---|---|---|---|
| 2,697,925 | 12/1954 | Goodman | 66/177 |
| 2,826,760 | 3/1958 | Rice | 2/409 |
| 3,670,529 | 6/1972 | Fregeolle | 66/177 |
| 3,798,677 | 3/1974 | Brown et al. | 2/409 |

*Primary Examiner*—H. Hampton Hunter

*Attorney, Agent, or Firm*—Vogel, Dithmar, Stotland, Stratman & Levy

[57] ABSTRACT

A method of forming a combination garment having a crotch area therein from a crotch piece and two tubular blank members each having a leg portion and an upper portion terminating in an open end and a run guard portion disposed between the leg portion and the upper portion, comprising the steps of longitudinally slitting the blank members between the open ends thereof and points in the run guard portions thereof to provide free edges, seaming the free edges between first aligned points adjacent to the open ends and a first predetermined point adjacent to the crotch area to provide a first seam, seaming the free edges between second aligned points opposite the first aligned points and adjacent to the open ends and a second predetermined point adjacent to the crotch area to provide a second seam, the first and second predetermined points at the inner ends of the first of second seams being spaced apart to provide an opening to receive the crotch piece, aligning one of the edges of the crotch piece with one of the free edges on the blank members and seaming the aligned edges between one of the seams and the run guard portion and then between the run guard portion and the other of the seams, and thereafter aligning the other edge of the crotch piece and the other free edge of the blank members and seaming the aligned edges from the end of one of the seams to the run guard portion and from the run guard portion to the end of the other of the seams.

9 Claims, 16 Drawing Figures

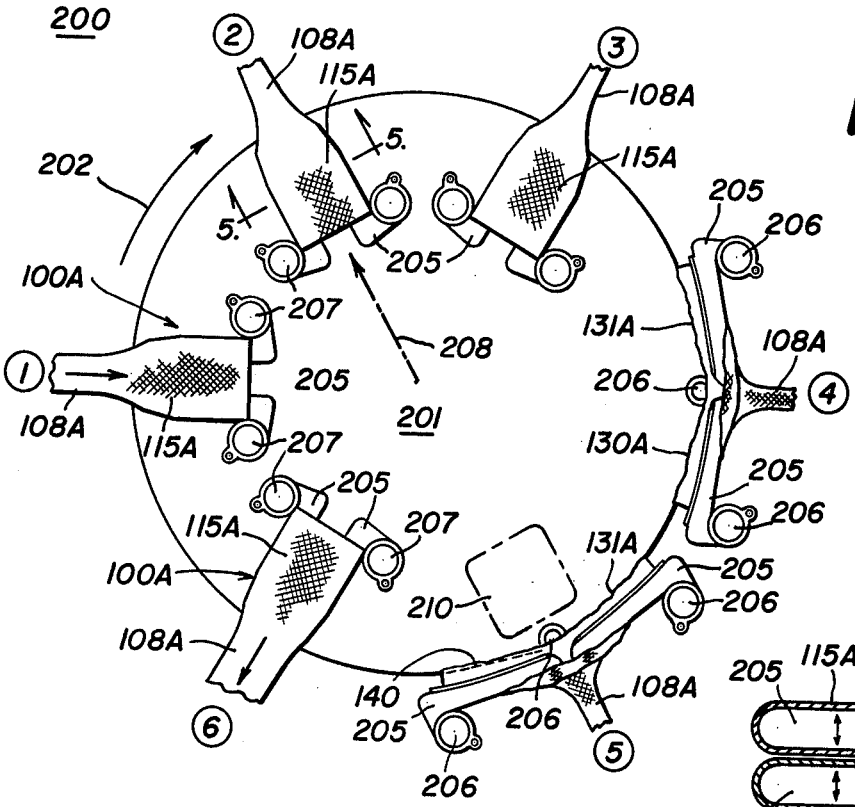
FIG. 4
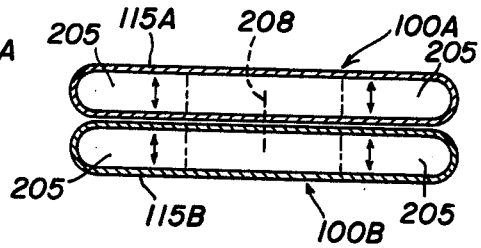
FIG. 5
FIG. 6
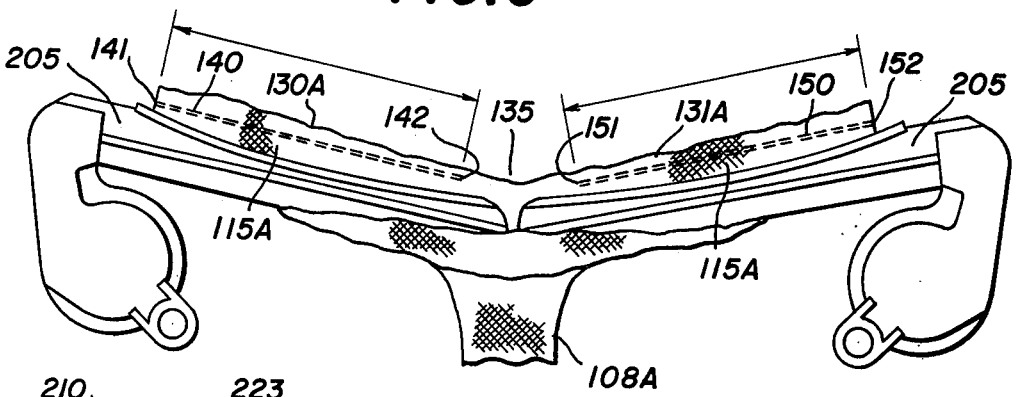
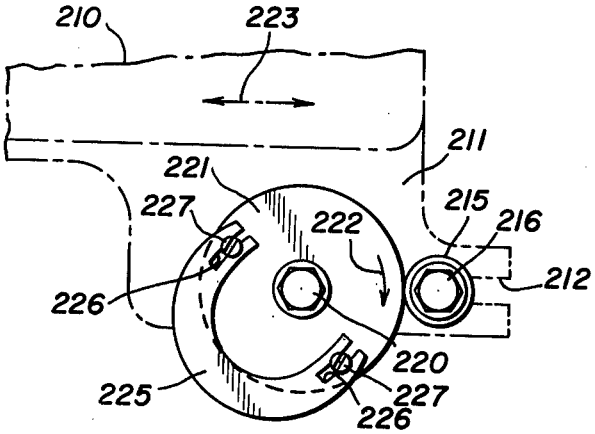
FIG. 7

FIG. 14
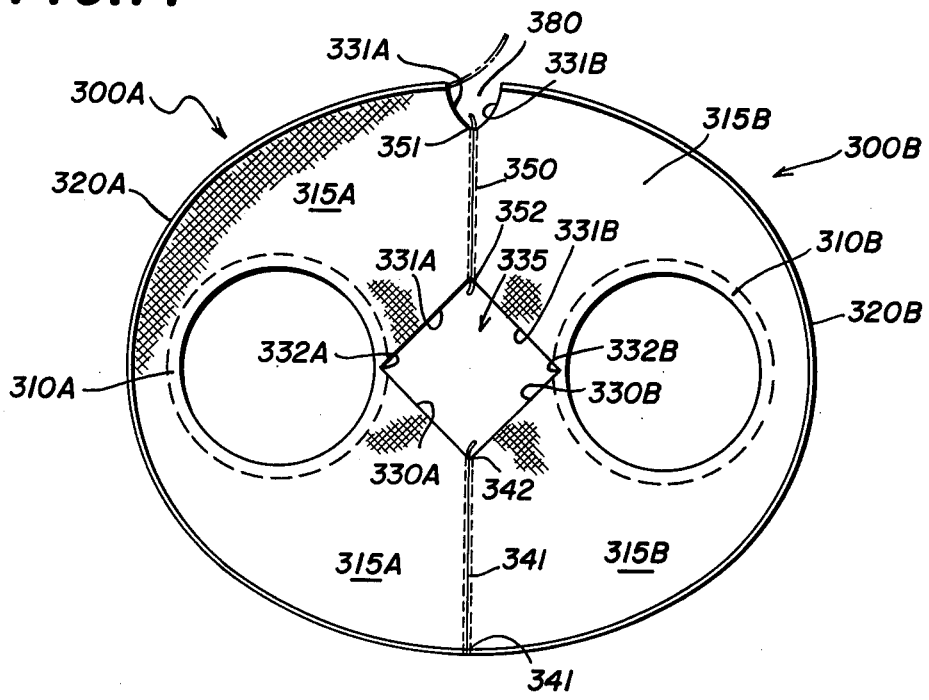
FIG. 15
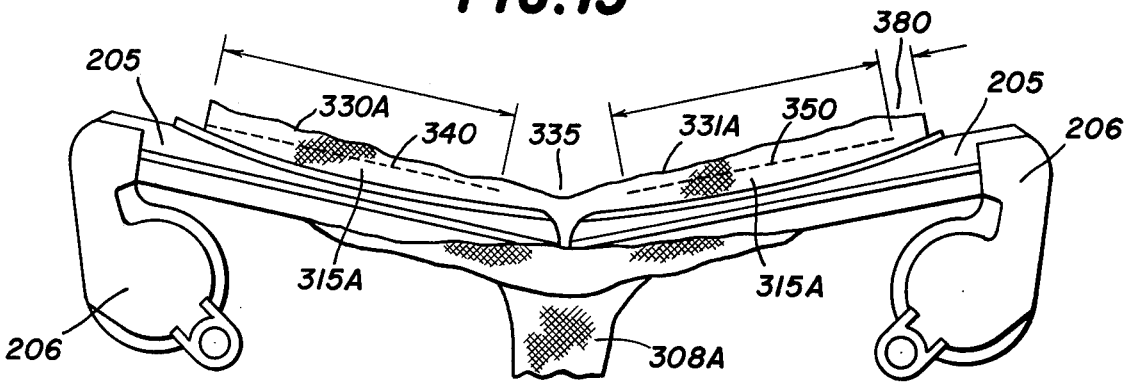
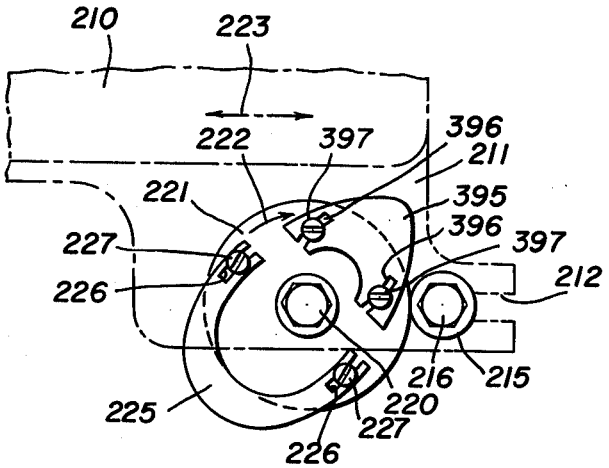
FIG. 16

METHOD AND APPARATUS FOR FORMING A COMBINATION GARMENT AND PRODUCTS THEREOF

BACKGROUND OF THE INVENTION

This invention relates to knitted combination garments, and more particularly to a panty hose garment in which two knitted stocking blanks are combined with a crotch piece to provide a panty hose.

Standard practice heretofore in forming panty hose has been to knit two stocking blank members and then to join those stocking blank members by slitting and seaming the same adjacent to the tops thereof to provide a panty portion with two integral leg portions. Such prior practice is illustrated in the Ferrell U.S. Pat. No. 3,675,247 granted July 11, 1972.

The method of the Ferrell patent has been heretofore modified to accomodate the insertion of a crotch piece by slitting and seaming two panty hose blank members, the crotch piece being sewn in as the two blank members are seamed together. An example of such a method is illustrated in the Brown et al. U.S. Pat. No. 3,798,677 granted Mar. 26, 1974 and assigned to the same assignee as the present application.

Although these prior methods have been generally satisfactory for the intended purpose, the seaming methods employed are expensive and it is difficult to obtain perfect seams and it is difficult to insert the crotch piece at the precise point desired in the garment.

SUMMARY OF THE INVENTION

The present invention provides a method and apparatus of forming a combination garment, such as a panty hose, wherein substantial costs savings are achieved and a perfect seaming job is provided, i.e., a precise gap is provided for the crotch piece at the precise point where it is required of the finished garment, and the seams on both the front and the back of the panty hose are perfect as are the seams around the crotch piece.

This is accomplished in the present invention, and it is an object of the present invention to accomplish these desired results, by providing a method of forming a combination garment having a crotch area therein from a crotch piece and two tubular blank members each having a leg portion and an upper portion terminating in an open end, the method comprising longitudinally slitting and seaming the two blank members to provide a first seam extending between first aligned points adjacent to the open ends and a first predetermined point adjacent to the crotch area and a second seam extending between second aligned points adjacent to the open ends and a second predetermined point adjacent to the crotch area, the first and second predetermined points at the inner ends of the first and second seams of the crotch area being spaced apart to provide an opening to receive the crotch piece therebetween, aligning one edge of the crotch piece with one of the free edges on the blank members between the seams in the crotch area and seaming the aligned edges between the crotch end of one of the seams and the crotch end of the other of the seams, and aligning the other edge of the crotch piece with the other of the free edges on the blank members between the seams in the crotch area and seaming the algined edges between the crotch end of one of the seams and the crotch end of the other of the seams.

Another object of the invention is to provide a method of forming a combination garment as set forth above, and including the steps of longitudinally slitting the blank members between the open ends thereof and the areas thereof corresponding to the crotch area of the combination garment to provide longitudinally extending free edges thereon, seaming the free edges on the two blank members between first aligned points adjacent to the open ends thereof and a first predetermined point adjacent to the crotch area to provide a first seam, seaming the free edges of the two blank members between second aligned points opposite the first aligned points and adjacent to the open ends thereof and a second predetermined point adjacent to the crotch area to provide a second seam, the first and second predetermined inner points at the inner ends of the first and second seams in the crotch area being spaced apart to provide an opening to receive the crotch piece therebetween, aligning one edge of the crotch piece with one of the free edges on the blank members between the seams in the crotch area and seaming the aligned edges between the crotch end of one of the seams in the crotch end of the other of the seams, and aligning the other edge of the crotch piece with the other of the free edges on the blank members between the seams in the crotch area and seaming the aligned edges between the crotch end of one of the seams and the crotch end of the other of the seams.

Yet another object of the invention is to provide a method of forming a combination garment of the type set forth, wherein the two blank members after slitting thereof are joined by seaming the aligned free edges on the two blank members from first aligned points adjacent to the open ends thereof to a first predetermined point adjacent to the crotch area and then from a second predetermined point adjacent to the crotch area to second aligned points adjacent to the open ends of the two blank members.

Still another object of the invention is to provide a method of forming a combination garment of the type set forth wherein the crotch piece is diamond-shaped and each tubular blank member is provided with a run guard portion between the leg portion and the upper portion, and the slitting of the blank members is between the open ends thereof and points in the run guard portions thereof, the crotch piece being sewn into the opening therefor by aligning two of the edges of the crotch piece with one of the free edges on the blank members between the seams in the crotch area and seaming the aligned edges between the crotch end of one of the seams and the run guard portion and between the run guard portion and the crotch end of the other of the seams, and thereafter aligning the other two edges of the crotch piece with the others of the free edges on the blank members between the seams and the crotch area and seaming the aligned edges between the crotch end of one of the seams and the run guard portion and between the run guard portion and the crotch end in the other of the seams.

Yet another object of the invention is to provide an apparatus for forming a partially completed combination garment having a crotch area therein from two tubular blank members each having a leg portion and an upper portion terminaing in an upper end, the apparatus comprising clamps for clamping longitudinally aligned portions of the upper portions of the two blank members, a slitter for longitudinally slitting the clamped blank members between the open ends thereof and the areas thereof corresponding to the crotch area of the combination garment to provide longitudinally extending aligned free edges thereon, mechanism for moving the clamps to place the free edges in essential alignment, drive mechanism for moving the aligned edges along a predetermined path, sewing mechanism disposed adjacent to the predetermined path and moveable towards the predetermined path and into engagement with the aligned free edges to seam the same together, and control mechanism for moving the seaming mechanism into engagement with the aligned free edges to provide a first seam extending between first aligned points adjacent to the open ends and a first predetermined point adjacent to the crotch area and then for moving the seaming mechanism out of engagement with the aligned edges in the crotch area to provide an opening and then for moving the seaming head into engagement with the aligned free edges to provide a second seam extending between a second predetermined point adjacent to the crotch and second aligned points adjacent to the open ends.

In connection with the foregoing object, it is another object of the invention to provide an apparatus of the type set forth wherein the control mechanism serves after formation of the second seam to move the seaming mechanism out of engagement with the aligned edges to leave an unseamed area adjacent to the second aligned points at the open ends to accommodate the attachment of a waistband to the combination garment.

Still another object of the invention is to provide a partially completed combination garment made using the methods and apparatus set forth hereinabove.

Further features of the invention pertain in the particular arrangement of the steps of the method and the parts of the apparatus and the portions of the garments, whereby the above outlined and additional operating features thereof are attained.

The invention, both as to its organization and method of operation, together with further features and advantages thereof will best be understood with reference to the following specification when taken in connection with the accompanying drawings.

BRIEF DESCRIPTION OF THE INVENTION

FIG. 4 is a plan view with certain portions broken away of an apparatus made in accordance with and embodying the principles of the present invention and useful in carrying out the methods of the present invention;

FIG. 5 is a view in vertical section on an enlarged scale along the line 5—5 in FIG. 4;

FIG. 6 is an enlarged fragmentary view showing the panty hose blank members in position upon the clamping arms immediately after completion of the seaming thereof;

FIG. 7 is a fragmentary view illustrating a portion of the drive mechanism for moving the seaming head toward and away from the blank members to be seamed;

Figure 1:
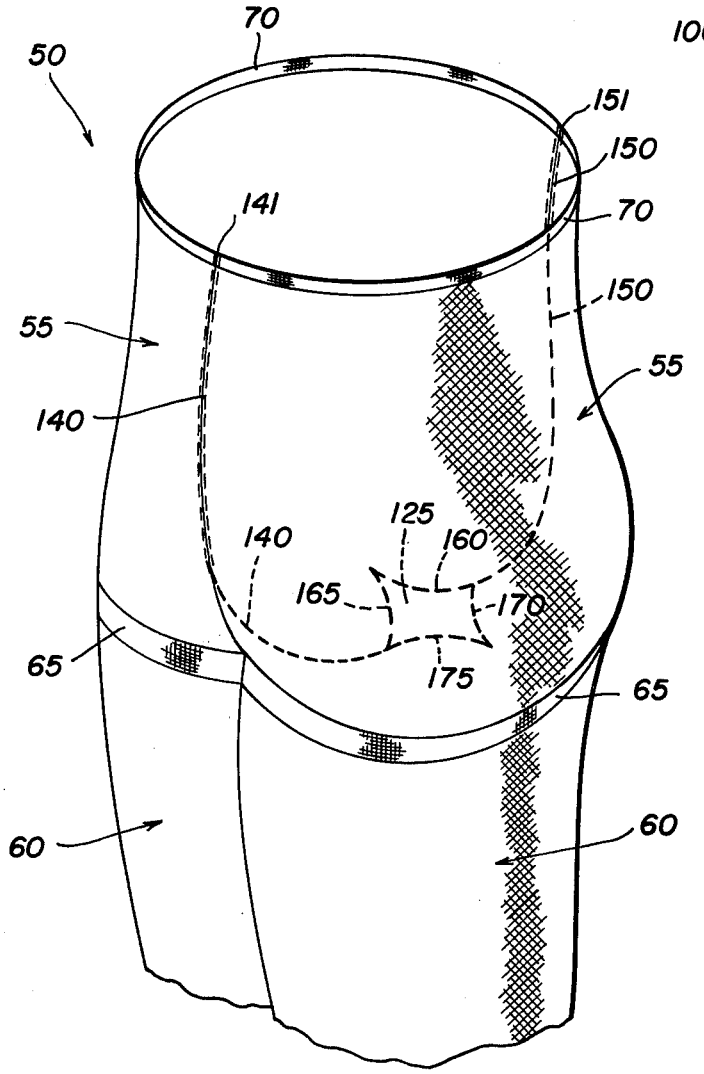
FIG. 1 is a front perspective view of a first preferred embodiment of a panty hose garment made in accordance with and embodying the principles of the present invention, the leg portions having been broken away.
Figure 8:
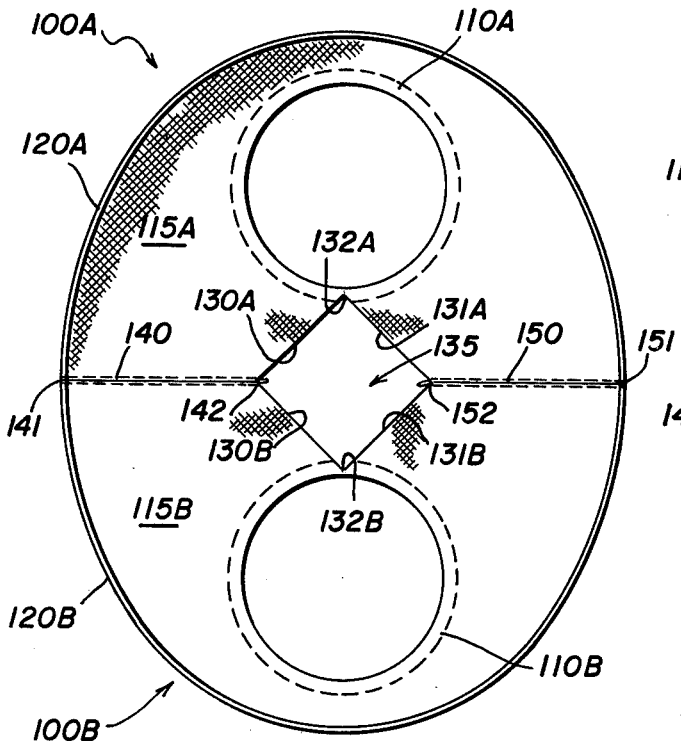
FIG. 8 is a plan view of a partially completed combination garment or panty hose after seaming of the blank members together but before seaming of the crotch piece in the crotch area.

FIGS. 10 to 13 diagrammatically illustrate the semaing of the crotch piece in the crotch opening to form the completed panty hose of FIG. 1;

FIG. 14 is a plan view similar to FIG. 8 showing a second preferred embodiment of a partially completed panty hose particularly adapted for the sewing of a separate waistband around the waist opening therein;

FIG. 15 is a plan view similar to FIG. 6 and illustrating the seaming of the partially completed panty hose of FIG. 14; and FIG. 16 is a view similar to FIG. 7 showing a portion of the drive mechanism for the sewing head used with the apparatus of FIG. 15 to produce the partially completed panty hose of FIG. 14.

DESCRIPTION OF THE PREFERRED EMBODIMENTS

Referring to the drawings, and particularly to FIG. 1 thereof, there is illustrated a combination garment in the form of a panty hose 50 made in accordance with and embodying the principles of the present invention, the panty hose 50 including a panty section 55 that extends substantially from the crotch area to the waist of the associated wearer. The panty hose 50 further includes a pair of seamless hose sections 60 integrally knit with the panty section 55 thereby to provide a combination garment. Disposed between the hose sections 60 and the panty section 55 are run guards 65. The upper end of the panty section 55 is open and is provided with a waistband 70 around the circumference thereof.

Figure 2:
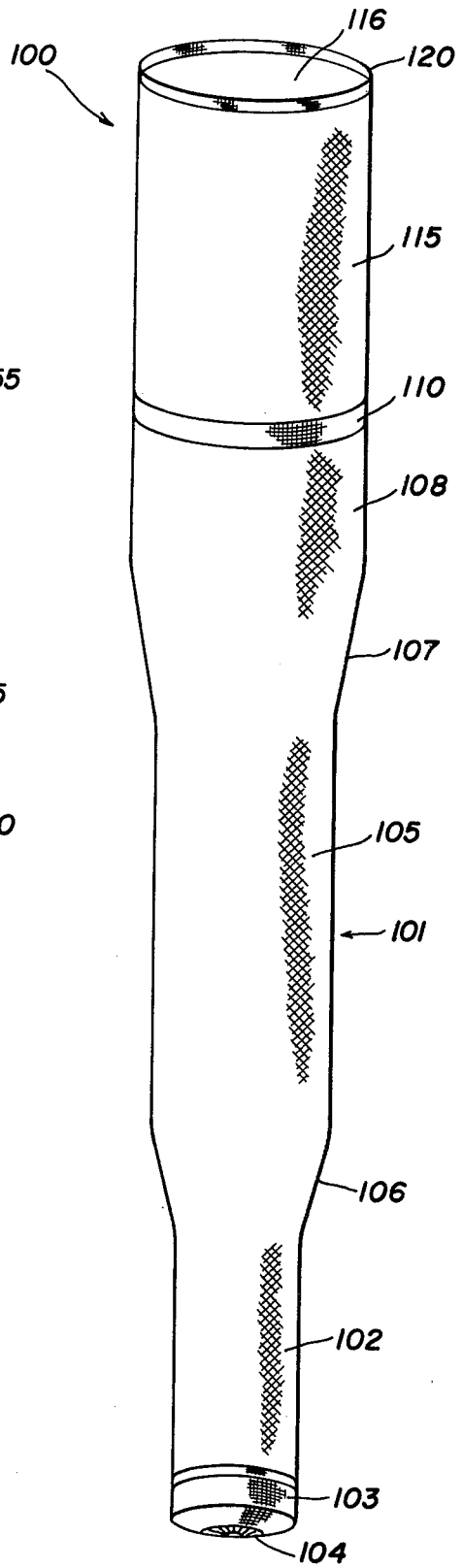
FIG. 2 is an elevational view of a stocking blank member for use in forming the panty hose garment of FIG. 1.

There is illustrated in FIG. 2 and elongated and generally tubular knit stocking blank member preferably formed of a nylon and generally designated by the numeral 100, the blank member 100 including a leg-and-foot portion 101, a run guard 110, a panty portion 115 and a waistband 120. The leg-and-foot portion 101 includes a pluarlity of integrally knit portions of different longitudinal and circumferential dimension. More specifically, the leg-and-foot portion 101 of the blank member 100 may be knit so that it includes a foot portion 102 on the lower end as viewed in FIG. 2, the foot portion in turn including a foot welt 103 and a closed end 104. Disposed above the foot portion 102 as seen in FIG. 2 is a leg portion 105 joined to the foot portion 102 by a first tapered section 106 and joined to a thigh portion 108 by a second tapered section 107.

At the upper end of the thigh portion 108 is knitted the relatively narrow integral annular run guard 110 extending circumferentially around the upper end of the thigh portion 108. Integral with the run guard 110 and extending upwardly therefrom is the panty portion 115 which may be formed of a heavier yarn than the leg-and-foot portion 101. At the upper end of the panty portion 115 and disposed around the periphery thereof and integral therewith is the narrow annular waistband 120 which may preferably be knitted of a highly elastic yarn such as Lycra Spandex. In addition, the waistband 120 may include a double layer of fabric. The uppermost end of the waistband 120 terminates in an upper edge which is generally cylindrical in outline and defines an open upper end 116 of the blank member 100.

The entire tubular blank member 100 is preferably knit of a thermoplastic stretch yarn such as a nylon yarn, to provide stretchability therefor. The term "stretch yarn" is intended to include all types of monofilament and multi-filament yarns capable of providing the desired stretch and shape characteristics for the finished garment. Preferably the leg-and-foot portion 101 is knit of 20 denier S & Z yarn while the panty portion 115 is knit of 40 denier S & Z yarn, but it will be understood that different weight yarns may be used for either portion. Also, as indicated hereinafter, various sections of the tubular blank member 100 may be knit of different denier yarn or different stitch patterns. For example, the foot portion 102, the leg portion 105 and the panty portion 115 may be knit of flat-knit, micromesh or non-run stitches. The run guard 110 may be formed of a run proof lock stitch pattern such as that disclosed in U.S. Pat. No. 3,430,463 granted to Nebel et al., whereby runs which might occur in the panty portion 115, will not be transmitted to the leg-and-foot portion 101, and vice versa.

Figure 3:
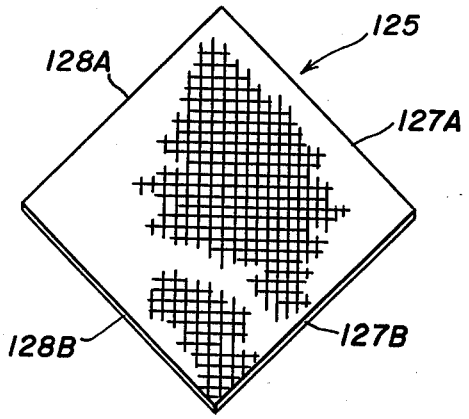
FIG. 3 is a plan view of a crotch piece forming a part of the panty hose garment of FIG. 1.

There is also provided, as is seen in FIG. 3, a crotch piece 125, the crotch piece 125 being diamond shaped. The crotch piece 125 may be made out of the same material as the leg-and-foot portion 101 described hereinabove, but preferably it is made of a cotton material rather than the nylon material of the blank member 100. The four edges of the crotch piece 125 have been labeled 127A, 127B, 128A and 128B for convenience.

In fabricating the panty hose 50 illustrated in FIG. 1, two of the blank members 100 as illustrated in FIG. 2 are first knit in a standard manner on a circular knitting machine. The two blank members 100 are then partially seamed together utilizing an apparatus generally designated by the numeral 200 and illustrated in FIGS. 4 to 7 of the drawings. The apparatus 200 is a Line Closer, Model LC-240 manufactured by the Takatori Machinery Mfg. Co., Ltd., of Japan. Referring to FIG. 4, the Line Closer machine 200 includes a turntable 201 generally circular in outline and mounted to rotate in a horizontal plane about its geometric center through six stations that are diagrammatically illustrated in FIG. 4 and are labeled with numerals 1 through 6, each numeral being circled. Mounted on the turntable 201 are six sets of clamp arms, each set of clamp arms including four individual clamp arms 205 arranged as best illustrated in FIG. 5. With the clamp arms 205 in the positions illustrated in stations 1, 2, 3 and 6, the arms 205 extend radially inwardly from pivot points 206 (seen in stations 4 and 5) and are arranged with respect to each other in each set of arms as illustrated in FIG. 5. More specifically, two of the arms 205 are in general horizontal alignment and the other two arms 205 are in general horizontal alignment below the first set of arms 205 and spaced slightly therefrom. The upper set of clamp arms 205 can receive at station 1 a first blank member 100A, and the other pair of clamp arms 205 can receive a second blank member 100B, the blank members 100A and 100B being slightly vertically spaced when the clamp arms 205 are in station 1 and immediately upon arrival at station 2. While at station 2, the vertically aligned pairs of clamp arms 205 are moved toward each other to clamp the fabric of the blank members 100A and 100B therebetween, and at station 2 scissors diagrammatically illustrated as at 208 move in and cut the adjacent portions of the blank members of 100A and 100B from the open ends thereof down (as seen in FIG. 2) and into the run guards 110A and 110B. This provides opposed free edges 130A and 131A on the blank member 100A and like free edges 130B and 131B on the blank member 100B.

Thereafter the clamp arms 200, while still clamping the free edges 130A-130B and 131A-131B together, are pivoted about pivots 206 to the positions illustrated in stations 4 and 5 of FIG. 4. This movement of the clamp arms 205 serves to place the aligned free edges 130A-130B in general arcuate alignment with the free edges 131A-131B as is illustrated at stations 4 and 5 in FIG. 4 and in FIG. 6.

Positioned adjacent to station 5 is a sewing head 210 that includes the usual seaming mechanism and presser foot needed to form seams in fabric contacted thereby. As the turntable 201 rotates in the direction of the arrow 202 in FIG. 4, the leading edge of the aligned free edges 130A-130B are engaged by the sewing head 210 and the presser foot is moved into its working position and the seaming or overedging mechanism forms a seam 140 from aligned points 141 at the original open ends of the blank members 100A and 100B and down the panty portions 115 to a predetermined point 142 spaced a predetermined distance from the run guard 110. At point 142 in FIG. 6, the sewing head 210 is moved out of engagement with the aligned free edges 130A-130B, i.e., the presser foot is lifted and the sewing mechanism withdrawn, whereby to leave a gap or opening 135 from point 142 to the beginning of a second seam 150 at point 152. Point 152 is spaced from the run guards 110 along the aligned free edges 131A-131B the same distance that point 142 is spaced from the run guards 110 along the free edges 130A-130B. The sewing head 210 is reengaged at point 152 with the aligned free edges 131A-131B and proceeds to form a seam 150 back to the open ends, and more specifically to the aligned points 151 that correspond to and are disposed opposite the aligned points 141.

After the sewing head 210 has produced the seams 140 and 150 with the opening or gap 135 therebetween, the pairs of clamp arms 205 are pivoted to the positions illustrated in station 6 of FIG. 4, and the vertical pairs of clamp arms 205 are moved apart to the positions of FIG. 5, thus to permit removal of the partially joined blank members 100A and 100B in the direction of the arrow at station 6.

In order to obtain the desired motion of the sewing head 210, thereby automatically to produce with a high degree of accuracy the seams 140 and 150 in FIG. 6 with the gap or opening 135 therebetween, the sewing head 210 is mounted upon a control bracket 211 which is shiftable toward and away from the periphery of the turntable 201. More specifically, the aligned free edges 130A-130B and 131A-131B are moved by the turntable 201 along a predetermined generally circular path past the sewing head 210, and the sewing head 210 is moved radially toward and away from the predetermined path so that when the sewing head 210 is in its outer position it produces the seams 140 and 150, and when the sewing head 210 is in its inner position, there is produced the opening or gap 135. The mechanism for moving the sewing head 210 is diagrammatically illustrated in FIG. 7. Mounted on the sewing heat 210 is the control bracket 211 having a slot 212 therein and on which a cam follower 215 is clamped in position by a bolt 216. A main cam shaft 220 is provided carrying a main cam 221 that engages the cam follower 215 and controls the position thereof to provide a continuous seam such as the seams 140 and 150 as the aligned free edges of blank members are passed thereby at station 5.

In order to obtain the opening 135 between the seams 140 and 150, the standard control mechanism for the sewing head 210 is modified by adding thereto a crescentshaped control cam 225 which is mounted upon the main cam 221. More specifically, the ends of the control cam 225 have slots 226 therein that receive screws 227 engaging the main cam 221 adjustably to position the outer surface of the control cam 225. The control cam 225 is positioned and shaped so as to withdraw the sewing head 210 from its sewing position when the parts are in the position to form the gap or opening 135. More specifically, the main control cam 221 serves to position the sewing head 210 first to form the seam 140, after which the control cam 225 moves the sewing head 210 radially inwardly to bring it out of contact with the material of the blank members 100A and 100B, and thereafter the control cam 225 disengages the cam follower 215 and permits it to reengage the main cam 221 so as to position the sewing head 210 outwardly to form the seam 150 as illustrated in FIG. 6.

There is illustrated in FIG. 8 of the drawings a plan view of the partially completed garment as it comes from station 6 of the machine 200 in FIG. 4. The seam 140 is shown extending from the aligned points 141 to the right to the predetermined point 142 where the seam 140 terminates. There are free cut edges 130A and 131A on the stocking blank member 100A and there are similar free cut edges 130B and 131B on the stocking blank member 100B providing the opening 135. Seaming begins at point 152 and the seam 150 extends from point 152 to point 151 that is diametrically opposite point 141 and is at the open end of the two blank members 100A and 100B. This manner of partially seaming the two blank members 100A and 100B together is very economical, provides a perfect seaming job along the seams 140 and 150, provides a precise gap or opening 135 between the predetermined points 142 and 152.

Figure 9:
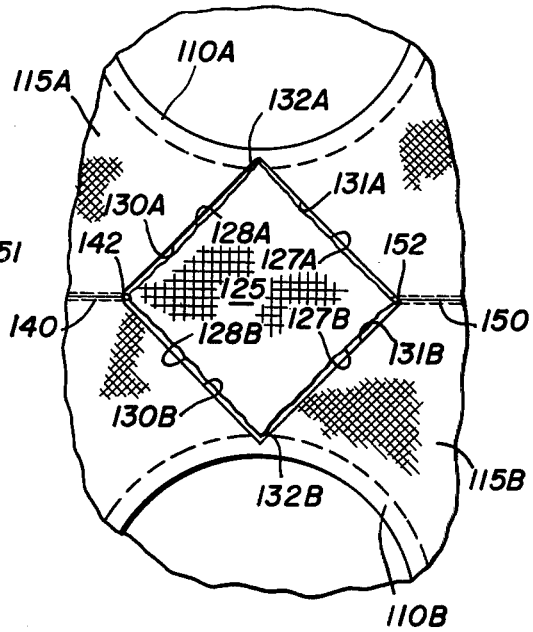
FIG. 9 is a view similar to FIG. 8 but showing only the crotch area thereof and illustrating the crotch piece in position ready for seaming to the tubular blanks.

To complete the panty hose 50 using the partial product of FIG. 8, one of the crotch pieces 125 is laid into the opening 135 as is diagrammatically illustrated in FIG. 9, the crotch piece having been cut from suitable material or knit or otherwise prepared. Preferably the crotch piece 125 is formed of cotton for its greater comfort and absorptive capacities.

Figure 10:
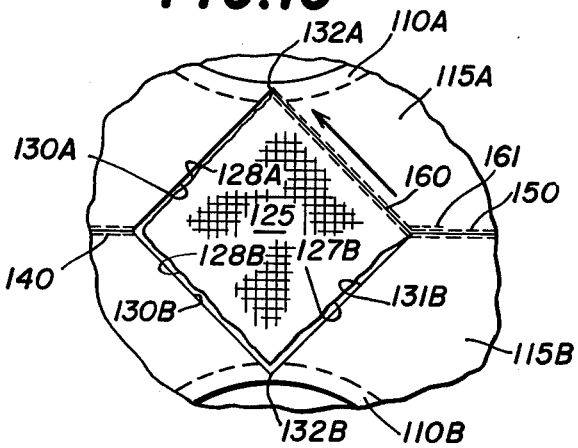
Figure 11:
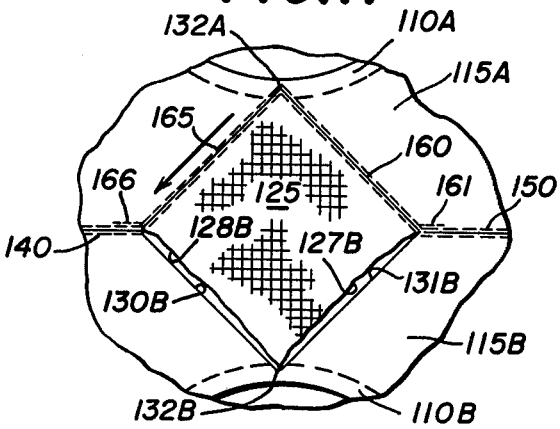
Figure 12:
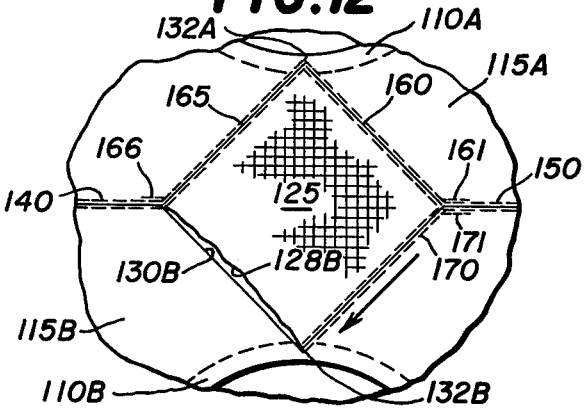
Figure 13:
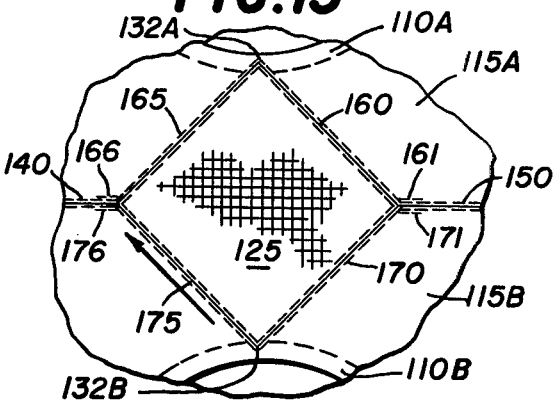

As seen in FIG. 9, the crotch piece 125 is preferably oriented such that edge 128A is in alignment with edge 130A, edge 127A is in general alignment with edge 131A, edge 128B is in general alignment with edge 130B and edge 127B is in general alignment with edge 131B. The assembly of FIG. 9 is then sewn on a standard sewing machine as is diagrammatically illustrated in FIGS. 10 to 13 in order to sew the crotch piece 125 in position to fill the opening 135 in the partially finished garment of FIG. 8. Referring first to FIG. 10, the edge 127A is aligned with the free edge 131A and a seam 160 is formed starting at a point in seam 150 to form a seam portion 161 and the seam 160 is continued in the direction of the arrow and into the run guard 110A. After aligning the edges 128A and 130A a seam is sewn (see FIG. 11) in the direction of the arrow from the run guard 110A, this seam being designated 165 and extending into the seam 140 as at 166. The operator then aligns the edges 127B and 131B and again beginning at a point in the seam 150 forms a seam 170 (see FIG. 12) including a seam portion 171 adjacent to the seam portion 161, the seam 170 proceeding in the direction of the arrow in FIG. 12 and into the run guard 110B. The edges 128B and 130B are then aligned and the seam proceeds as in FIG. 13 from the run guard 110B to the seam 140, this seam being designated 175 and having a portion 176 extending into the seam 140 and adjacent to the seam portion 166.

These results the panty hose 50 illustrated in FIG. 1, the seams 160, 165, 170, 175 being perfect so as to provide an improved panty hose 50. The method described is also more economical then methods utilized heretofore, as well as providing a superior end product in the form of the panty hose 50.

It will be appreciated that the partially completed garment of FIG. 8 can be made by methods other than that illustrated in FIGS. 4 to 7 and on machines other than the machine 200 illustrated in FIGS. 4 to 7. For example, the two blank members 100A and 100B may be manually slit after knitting from the open end thereof into the run guards 110A and 110B, after which the blank members may be seamed together manually front and back leaving the opening 135 therein. Thereafter the crotch piece 125 can be sewn into position as illustrated diagrammatically in FIGS. 9 to 13.

Alternatively, the blank members 100A and 100B may be slit on the knitting machine using the hot wire method. Thereafter the pre-slit blank members 100A and 100B may be manually seamed front and back with the crotch opening 135 left therein. Thereafter the crotch piece 125 is seamed into the garment using the method illustrated in FIGS. 9 to 13.

In yet another method, two panty hose blanks 100A and 100B may be automatically seamed or manually seamed as illustrated in the Ferrell U.S. Pat. No. 3,675,247 discussed above, after which the crotch seam can be slit to provide the opening 135. Thereafter the crotch piece 125 is sewn in place using the method illustrated in FIGS. 9 to 13 of the drawings.

There is illustrated in FIG. 14 of the drawings a modified form of incomplete garment made in accordance with the methods and utilizing the improved apparatus of the present invention. The incomplete garment in FIG. 14 is generally constructed like the incomplete garment of FIG. 8, and therefore where appropriate numbers in the 300 series have been applied to the parts of the garment in FIG. 14 that correspond to like parts numbered in the 100 series in FIG. 8. More specifically, two blank members 300A and 300B identical to the blank members 100A and 100B described above have been partially joined by a seam 340 identical to the seam 140 described above and a seam 350 which is similar to, but not identical to, the seam 150 described above. More specifically, the seam 350 terminates at a point spaced from the open end of the panty portions 315A and 315B, the seam 350 terminating at a point 351 which is spaced from the open ends of the blank members so as to leave two free edges 331A and 331B with a gap 380 therebetween. The purpose of the gap 380 is to facilitate the sewing of a waistband onto the incomplete garment, this structure minimizing the bulkiness of overlapping seams at this point in the construction.

The incomplete garment of FIG. 14 has in it a blank or opening 335 identical to the opening 135 described above, and a crotch piece is sewn into the opening 335 in the same manner as and using the same methods that the crotch piece 125 is sewn into the opening 135 as illustrated in FIGS. 9 to 13.

Illustrated in FIGS. 15 and 16 is a modification of the machine 200 that is required to provide the gap 380 adjacent to the open end of the blank members. To this end a second cam 395 is bolted to the main cam 221, the cam 395 being relatively pointed in construction and having two elongated slots 396 receiving screws 397 to attach the cam 395 to the main cam 221. The result of the action of the cam 395 against the cam follower 215 is to withdraw the sewing head 210 from contact with the cut edges 331A and 331B adjacent to the right hand portion of FIG. 15, whereby to leave a gap 380 as illustrated. In all other respects, the apparatus of FIGS. 15 and 16 operates as does the apparatus of FIGS. 6 and 7.

While there have been described what at present considered to be the preferred embodiments of the invention, it will be understood that various modifications may be made therein, and it is intended to cover in the appended claims all such modifications that fall within the true spirit and scope of the invention.

What is claimed is:

1. A method of forming a combination garment having a crotch area therein from a crotch piece and two circularly knit tubular blank members each having a leg portion and an upper portion terminating in an open end, the method comprising simultaneously slitting the blank members between the open ends thereof and the areas thereof corresponding to the crotch area of the combination garment to provide longitudinally extending free edges thereon while firmly gripping the blank members adjacent to said free edges and along substantially the entire length of said edges, continuously seaming the free edges on the two blank members between first aligned points adjacent to the open ends thereof and a first predetermined point adjacent to the crotch area to provide a first seam and between a second predetermined point adjacent to the crotch area and second aligned points opposite the first aligned points and adjacent to the open ends of said blank members to provide a second seam, the first and second predetermined points at the inner ends of the first and second seams in the crotch area being spaced apart to provide an opening to receive the crotch piece therebetween, aligning one edge of the crotch piece with one of the free edges on the blank members between the seams in the crotch area and seaming the aligned edges between the crotch end of one of the seams and the crotch end of the other of the seams, and aligning the other edge of the crotch piece with the other of the free edges on the blank members between the seams in the crotch area and seaming the aligned edges between the crotch end of one of the seams and the crotch end of the other of the seams, thereby to form a completed combination garment.

2. The method of forming a combination garment as set forth in claim 1, wherein the first and second seams extend to the open ends of the blank members.

3. The method of forming a combination garment as set forth in claim 1, wherein the first seam extends to the open end of the blank members, and the second seam terminates at a point spaced from the open ends of the blank members to accommodate the attachment of a waistband thereto.

4. A method of forming a combination garment having a crotch area therein from a crotch piece and two circularly knit tubular blank members each having a leg portion and an upper portion terminating in an open end, the method comprising simultaneously longitudinally slitting the blank members between the open ends thereof and the areas thereof corresponding to the crotch area of the combination garment to provide longitudinally extending free edges thereon while gripping the blank members adjacent to said free edges along substantially the entire lengths thereof, continuously seaming the aligned free edges on the two blank members from first aligned points adjacent to the open ends thereof to a first predetermined point adjacent to the crotch area and then from a second predetermined point adjacent to the crotch area to second aligned points adjacent to the open ends of the two blank members, the first and second predetermined points being spaced apart to provide an opening to receive the crotch piece therebetween, aligning one edge of the crotch piece with one of the free edges on the blank members between the seams in the crotch area and seaming the aligned edges between the crotch end of one of the seams and the crotch end of the other of the seams, and aligning the other edge of the crotch piece with the other of the free edges on the blank members between the seams in the crotch area and seaming the aligned edges between the crotch end of one of the seams and the crotch end of the other of the seams, thereby to form a completed combination garment.

5. The method of forming a combination garment as set forth in claim 4, wherein the first and second seams extend to the open end of the blank members.

6. The method of forming a combination garment as set forth in claim 4, wherein the first seam extends to the open ends of the blank members, and the second seam terminates at a point spaced from the open ends from the blank members to accommodate the attachment of a waistband thereto.

7. A method of forming a combination garment having a crotch area therein from a diamond-shaped crotch piece and two circularly knit tubular blank members each having a leg portion and an upper portion terminating in an open end and a run guard portion disposed between the leg portion and the upper portion, the method comprising simultaneously longitudinally slitting the blank members between the open ends thereof and points in the run guard portions thereof to provide longitudinally extending free edges thereon while gripping the blank members adjacent to said free edges and along substantially the entire length of said edges, continuously seaming the free edges on the two blank members between first aligned points adjacent to the open ends thereof and a first predetermined point adjacent to the crotch area to provide a first seam and between a second predetermined point adjacent to the crotch area and second aligned points opposite the first aligned points and adjacent to the open ends of said blank members to provide a second seam, the first and second predetermined points at the inner ends of the first and second seams in the crotch area being spaced apart to provide an opening to receive the crotch piece therebetween, aligning two of the edges of the crotch piece with one of the free edges on the blank members between the seams in the crotch area and seaming the aligned edges between the crotch end of one of the seams and the run guard portion and between the run guard portion and the crotch end of the other of the seams, and aligning the other two edges of the crotch piece with the other of the free edges on the blank members between the seams in the crotch area and seaming the aligned edges between the crotch end of one of the seams and the run guard portion and between the run gurad portion and the crotch end of the other of the seams, thereby to form a completed combination garment.

8. The method of forming a combination garment as set forth in claim 7, wherein the first of second seams extend to the open ends of the blank members.

9. The method of forming a combination garment as set forth in claim 7, wherein the first seam extends to the open ends of the blank members, and the second seam terminates at a point spaced from the open ends of the blank members to accommodate the attachment of a waistband thereto.

* * * * *

UNITED STATES PATENT AND TRADEMARK OFFICE

CERTIFICATE OF CORRECTION

PATENT NO. : 4,100,624

DATED : July 18, 1978

INVENTOR(S) : Farris L. Davis

It is certified that error appears in the above-identified patent and that said Letters Patent are hereby corrected as shown below:

Column 1, line 66, "algined" should be --aligned--.
Column 3, line 33, "in" should be --to--.
Column 4, line 9, "maing" should be --aming--;
line 38, "and" (second occurrence) should be -- an --;
line 44, "pluarlity" should be --plurality--.
Column 8, line 7, "These" should be --There--.
Column 9, line 12, after "what" insert --are--;
line 23, after "simultaneously" insert --longitudinally--.
Column 10, line 66, "gurad" should be --guard--.

Signed and Sealed this

*Ninth* Day of *January 1979*

[SEAL]

*Attest:*

RUTH C. MASON
*Attesting Officer*

DONALD W. BANNER
*Commissioner of Patents and Trademarks*